US009312086B2

(12) United States Patent
Kloss et al.

(10) Patent No.: US 9,312,086 B2
(45) Date of Patent: Apr. 12, 2016

(54) PROXIMITY SWITCH WITH SNAP LOCK

(75) Inventors: Troy A. Kloss, Leland, NC (US); Douglas Coe, Waxhaw, NC (US); John William Petty, Hope Mills, NC (US); Cathleen Mary Clausen, Wilmington, NC (US)

(73) Assignee: Dynapar Corporation, Gurnee, IL (US)

( * ) Notice: Subject to any disclaimer, the term of this patent is extended or adjusted under 35 U.S.C. 154(b) by 353 days.

(21) Appl. No.: 13/880,161

(22) PCT Filed: Oct. 21, 2011

(86) PCT No.: PCT/US2011/057184

§ 371 (c)(1),
(2), (4) Date: Apr. 18, 2013

(87) PCT Pub. No.: WO2012/061031

PCT Pub. Date: May 10, 2012

(65) Prior Publication Data

US 2013/0222087 A1 Aug. 29, 2013

Related U.S. Application Data

(60) Provisional application No. 61/406,350, filed on Oct. 25, 2010, provisional application No. 61/438,445, filed on Feb. 1, 2011.

(51) Int. Cl.
*H01H 36/00* (2006.01)

(52) U.S. Cl.
CPC ..... *H01H 36/00* (2013.01); *H01H 36/0006* (2013.01)

(58) Field of Classification Search
CPC ..... H01H 36/00; H01H 36/0006; H01H 36/0013; H01H 2051/2218
USPC ..... 335/205–207
See application file for complete search history.

(56) References Cited

U.S. PATENT DOCUMENTS

| | | | | | |
|---|---|---|---|---|---|
| 2,548,581 | A * | 4/1951 | Bigelow | H01H 36/0073 | 200/252 |
| 3,105,551 | A * | 10/1963 | Ehlert | E21B 41/00 | 166/63 |
| 3,109,908 | A * | 11/1963 | Clason | H01H 35/34 | 166/DIG. 42 |
| 3,167,623 | A * | 1/1965 | Kaleta | G01F 23/56 | 200/318 |
| 3,414,853 | A * | 12/1968 | Motis | H01H 13/506 | 335/207 |
| 3,980,375 | A | 9/1976 | LaMarche | | |
| 4,291,761 | A * | 9/1981 | Watson | H01H 36/00 | 166/66 |
| 4,295,390 | A | 10/1981 | Buchta | | |
| 4,336,518 | A * | 6/1982 | Holce | H01H 36/004 | 335/151 |
| 4,788,517 | A * | 11/1988 | Meister | H01H 36/00 | 200/61.62 |
| 5,609,278 | A | 3/1997 | Fresco | | |
| 6,752,437 | B1 | 6/2004 | Bantle et al. | | |
| 2005/0077162 | A1 | 4/2005 | Mori | | |
| 2007/0184682 | A1 | 8/2007 | Gobron | | |
| 2008/0266035 | A1 | 10/2008 | Rohrig et al. | | |
| 2009/0242590 | A1 | 10/2009 | Saveliev et al. | | |

* cited by examiner

*Primary Examiner* — Mohamad Musleh
(74) *Attorney, Agent, or Firm* — Beusse, Wolter, Sanks & Maire, PLLC

(57) ABSTRACT

A proximity switch (20, 20A) that snaps quickly and locks between first and second positions of movable electrical contacts (32). A magnet (42) moves a first shaft (26) toward a magnetic target (62) when the target is proximate a sensor end (43) of the switch housing (22). A spring (44) urges the first shaft (26) away from the sensor end. Movement of the first shaft causes a second spring (64) to urge a second shaft (28) in the direction of the first shaft. Next the second shaft is released (52) to move in the direction urged by the second spring. The switch may be adapted to a client cable pin configuration via an adapter plug (80) in the housing with a flexible interconnection circuit (82) folded in a chamber between the adapter plug and leads from fixed electrical contacts (38) of the switch.

20 Claims, 5 Drawing Sheets

FIG 10
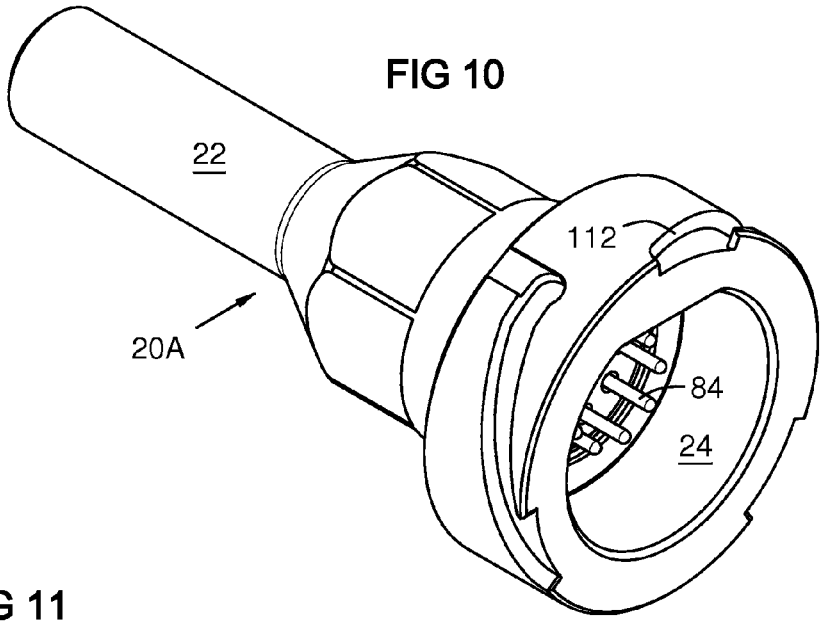
FIG 11
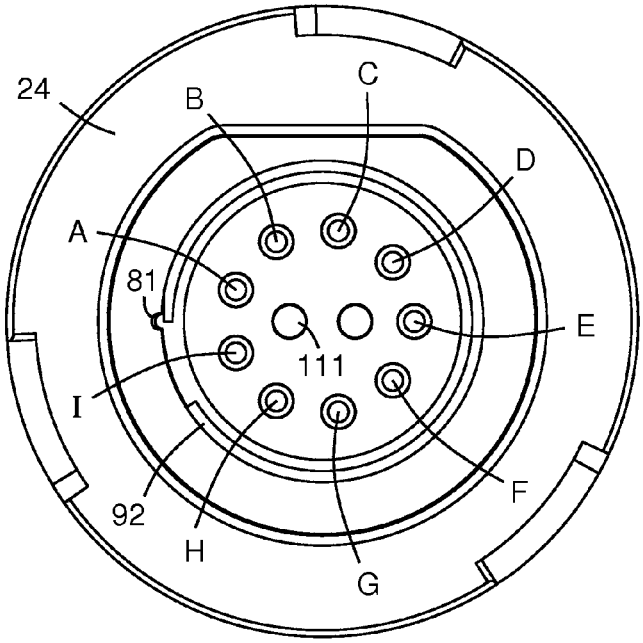
FIG 12
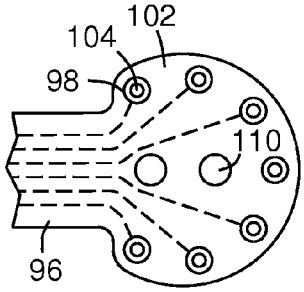
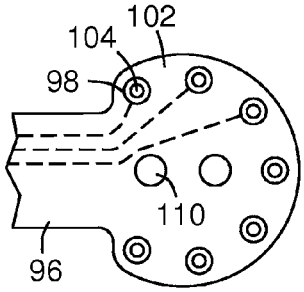
FIG 13

PROXIMITY SWITCH WITH SNAP LOCK

This application claims benefit of the 25 Oct. 2010 filing date of U.S. provisional patent Application No. 61/406,350, and the 1 Feb. 2011 filing date of U.S. provisional patent Application No. 61/438,445.

FIELD OF THE INVENTION

This invention relates generally to magnetic proximity switches, and particularly to such switches designed for sensing and monitoring the operating position of critical industrial equipment, and opening or closing an electrical circuit in response thereto.

BACKGROUND OF THE INVENTION

Magnetic proximity switches are used, for example, to sense the position of an industrial valve, for example in nuclear power plants. A magnet or magnetic material called a "target" may be mounted on the valve stem. A magnetic proximity switch is located adjacent to the valve stem so that the target moves within a given distance of the switch when the valve is in a given position, such as fully open or fully closed. The target in this position attracts a magnet in the switch, which closes and/or opens electrical contacts in the switch, resulting in a signal being communicated to a controller. Two proximity switches may be used—one for the open valve position and one for the closed valve position. In this configuration the two switches can confirm each other and can verify that full opening or closing has occurred. An example of such a switch is described in U.S. Pat. No. 7,489,217.

BRIEF DESCRIPTION OF THE DRAWINGS

The invention is explained in the following description in view of the drawings that show:

FIG. 10 is a perspective view of the embodiment of FIG. 8.

FIG. 11 is a connector-end view of the embodiment of FIG. 8.

FIG. 12 shows an end of the flexible circuit configured for six active pin-out conductors for a double-pole double-throw configuration of the switch.

FIG. 13 shows an end of the flexible circuit configured for three active pin-out conductors for a double-pole double-throw configuration of the switch.

DETAILED DESCRIPTION OF THE INVENTION

The present inventors have recognized premature contact wear in prior art magnetic proximity switches, and further have recognized that the wear can result from electrical sparking during contact bounce. The inventors have further recognized that such contact bounce may occur as a result of closure rebound or from operational vibrations and seismic events. The present invention addresses these problems.

Figure 1:
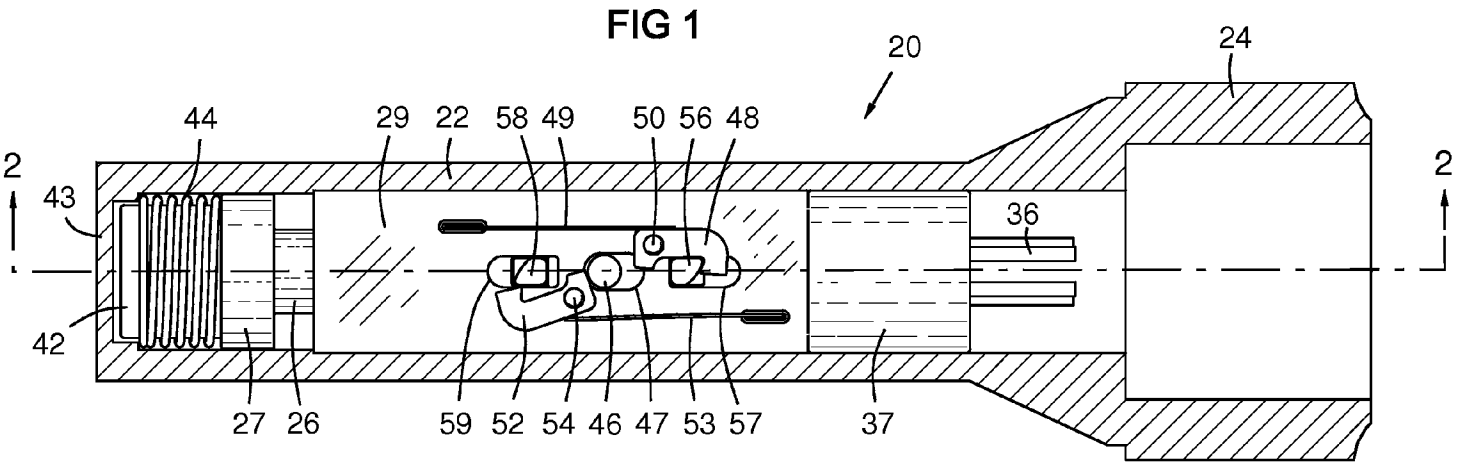
FIG. 1 is a side view of internal parts of a proximity switch according to aspects of the invention with a switch housing in section.
Figure 2:
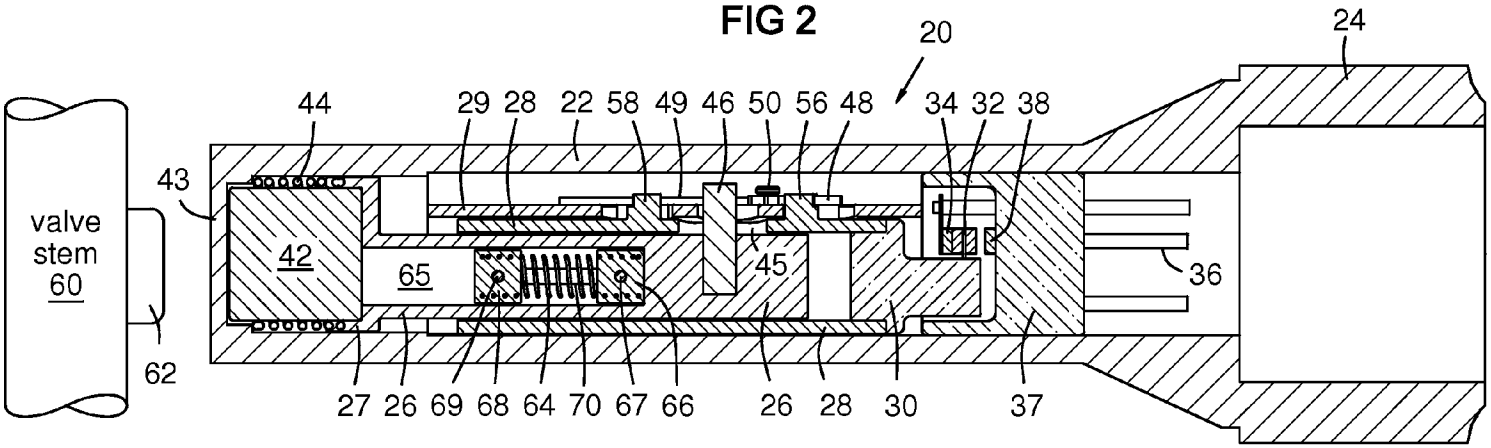
FIG. 2 is a sectional view taken along line 2-2 of FIG. 1.

FIGS. 1 and 2 show a proximity switch 20 with a housing 22 that has a cable coupler 24 for a signal cable on the right end. Herein, "right" and "left" will be used for convenience to mean toward the cable end 24 of the housing and toward the sensor end 43 of the housing respectively, as shown in FIG. 1. The coupler 24 may have internal threads as known in the art. An inner shaft 26 slides linearly within an outer shaft 28, which slides linearly between the housing 22 and a shaft support 29 that is fixed relative to the housing. A contact block 30 is attached to the right end of the outer shaft 28. It supports one or more bi-directional movable contacts 32 that alternately close against first and second fixed contacts 34, 38. This switching action alternately creates and breaks continuity between pairs of leads 36 held by a lead block 37.

A sensor magnet 42 is attached to the left end of the inner shaft 26 in a retainer 27, and functions as a magnetic target proximity sensor. A return spring 44 urges the inner shaft rightward. An engagement pin 46 is attached to the inner shaft 26 and extends through a slot 45 in the outer shaft 28 and through a slot 47 in the shaft support 29. The engagement pin 46 alternately pushes open one of two locking claws 48, 52. In FIG. 1 the pin 46 is moving leftward, and is pushing open the left claw 52. Each claw 48, 52 pivots to hook or release a respective locking post 56, 58. The locking posts 56, 58 extend from the outer shaft 28 through slots 57, 59 in the shaft support 29. Each claw 48, 52 is urged toward its locked position by a respective spring 49, 53. The claw axles 50, 54 extend from the shaft support 29, thus they remain in a fixed location relative to the housing 22.

FIG. 2 is a sectional view taken along line 2-2 of FIG. 1. A valve stem 60 (not necessarily to scale) is shown proximate the left end 43 of the proximity switch 20. A magnet 62 or magnetic material may be attached to the valve stem to function as a target for the proximity switch. When the valve stem 60 is in a given position, the target is opposite the left end or sensor end 43 of the proximity switch 20, and thus attracts the sensor magnet 42, which moves the inner shaft 26 leftward. This moves the engagement pin 46 leftward, which opens the left claw 52 as shown in FIG. 1.

Before this claw release occurs, the outer shaft 28 is locked into position relative to the housing 22 so that the left movement of the inner shaft 26 compresses a spring 64 that is retained between two spring blocks 66, 68 that slide within a spring chamber 65 in the inner shaft 26. Movement of the spring blocks 66, 68 is limited by guide pins 67, 69 that extend from the spring blocks through guide slots 70 in the inner shaft 26 and through corresponding guide slots 71 in the outer shaft, as later shown. This spring mechanism 64, 66, 67, 68, 69, 70, 71 causes an accumulation of spring force that urges the outer shaft 28 in the direction of movement of the inner shaft 26, so that when the respective claw (52 for leftward movement) is released by the engagement pin 46, the outer shaft suddenly moves relative to the housing in the direction of the inner shaft, either left or right (leftward in the illustrated case). This causes the movable contact 32 to close suddenly against the left or right stationary contact respectively (the left contact 34 in this case). At that time, the opposite claw (the rightward claw 48 in this case) hooks the opposite locking post 56. This again retains the outer shaft 28 stationary relative to the housing 22 and locks the closed contacts 32, 34 together, preventing any contact bounce or chatter due to closure rebound, operational vibrations or seismic activity.

Figure 3:
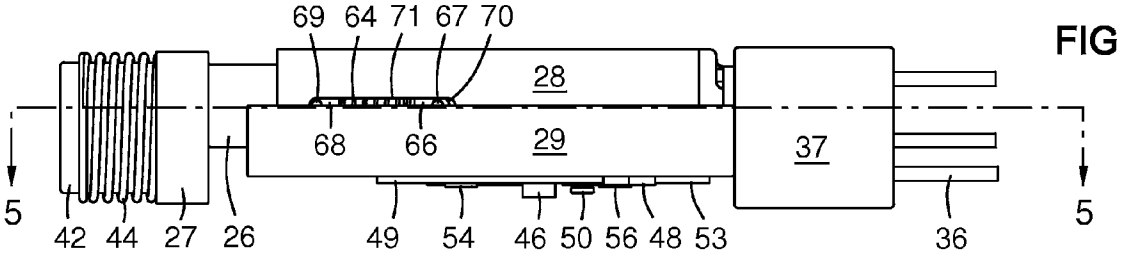
FIG. 3 is a top view of internal parts of the switch with the shaft support partly cut away to show part of the outer shaft.

FIG. 3 is a top view of internal parts of the switch, absent the housing 22. The shaft support 29 is cut away along line 5-5 to show a partial top view of the outer shaft 28. The outer shaft is more fully shown in FIG. 4.

Figure 4:
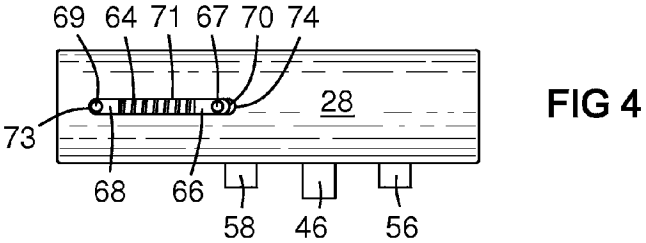
FIG. 4 is a top view of the outer shaft.

FIG. 4 shows a top view of the outer shaft 28, with the locking posts 56, 58 extending therefrom, and a slot 71 there through with left and right ends 73, 74. The right end of the corresponding slot 70 of the inner shaft 26 can be seen. The engagement pin 46 extends from the inner shaft 26 through slot 45 in the outer shaft 28 (slot 45 and inner shaft 26 are not visible in this view). Guide pin 69 is pushing leftward on the left end 73 of the slot 71 due to compression of the spring 64. Thus, the outer shaft 28 will snap leftward when locking pin 58 is released by the respective claw 52.

Figure 5:
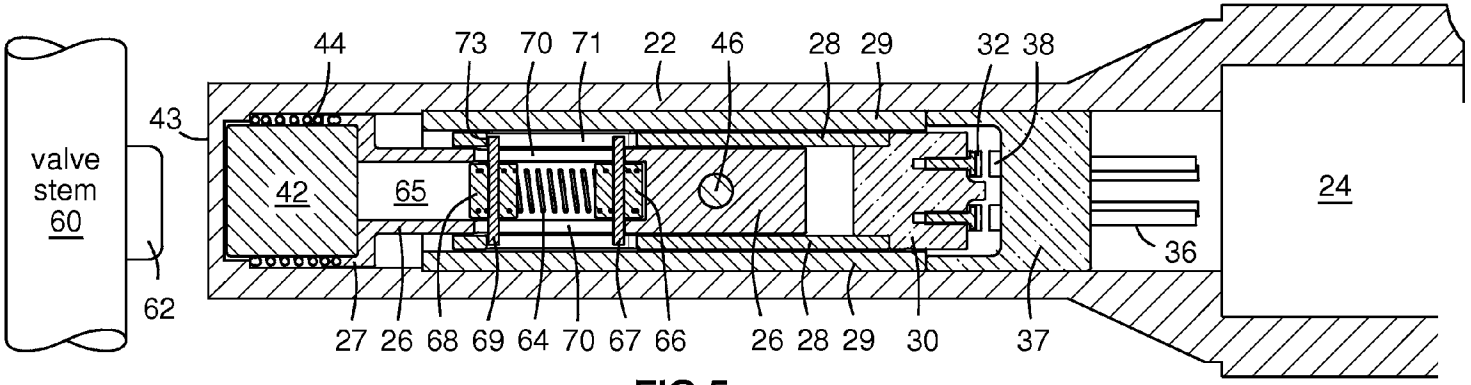
FIG. 5 is a sectional view of the entire switch taken along a plane of line 5-5 of FIG. 3, with a magnetic target in range, causing leftward movement of the sensor magnet and the movable contact.

FIG. 5 is a sectional view taken along line 5-5 of FIG. 3. The sensor magnet 42 is fully leftward, due to the magnetic target 62 being in range, causing the inner shaft 26 to push leftward on the right spring block 66, compressing the spring 64, and thus pushing the guide pin 69 leftward against the left end 73 of the guide slot 71 in the outer shaft 28. The left claw 52 has been released, allowing the outer shaft 28 to snap leftward. The movable contact 32 has separated from the right fixed contact 38.

Figure 6:
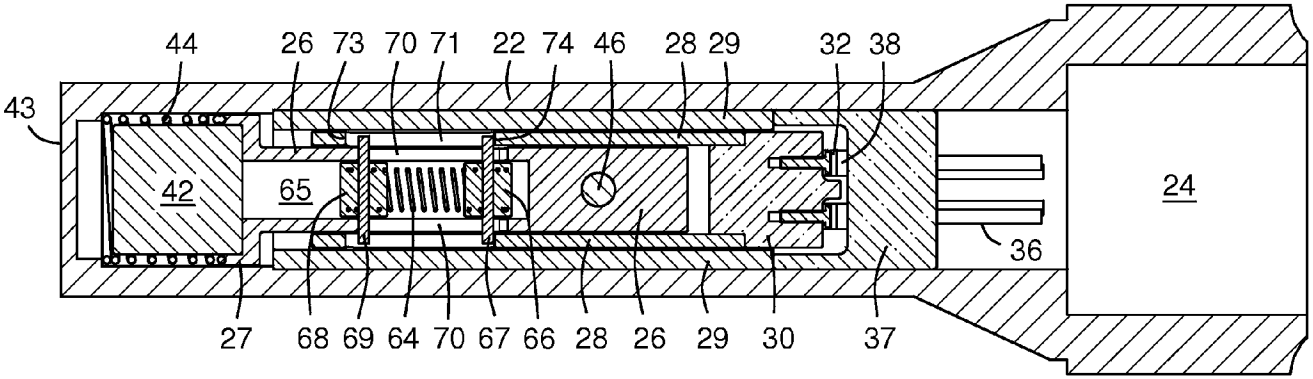
FIG. 6 is a sectional view as in FIG. 5, with no magnetic target in range, resulting in rightward movement of the sensor magnet and the movable contact.

FIG. 6 is a sectional view as in FIG. 5, but with the switch in the opposite position. The sensor magnet 42 is fully rightward, since no magnetic target is in range, causing the spring 44 to push the inner shaft 26 rightward. The inner shaft 26 pushes rightward on the left spring block 68 via the pin 69, compressing the spring 64, and thus pushing the right guide pin 67 rightward against the right end 74 of the guide slot 71 in the outer shaft 28. The right claw 48 has been released, allowing the outer shaft 28 to snap rightward. The movable contact 32 has closed against the right fixed contact 38.

Figure 7:
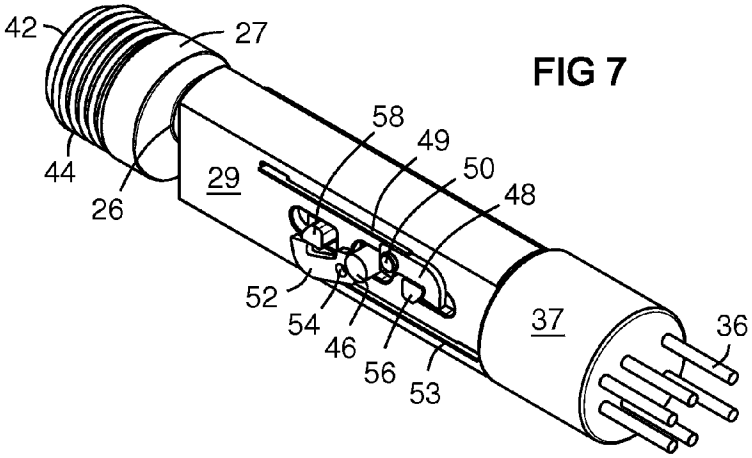
FIG. 7 is a perspective view of internal parts of the switch.

FIG. 7 is a perspective view of the internal parts of the switch, absent the housing 22. It shows the magnet 42 and first spring 44, which are on the inner shaft 26 (mostly hidden). It also shows the lead block 37, and the shaft support 29. The shaft support hides the outer shaft 28 in this view.

Exemplary materials of construction for the switch 20 include: housing 22, outer shaft 28, shaft support 29 and engagement pin 46 may be 300 series stainless steel or Nitronic® 60 material; inner shaft 26 may be 400 series stainless steel or carbon steel; sensor magnet 42 may be a samarium cobalt rare earth magnet; and contact block 30 and lead block 37 may be Macor® machineable glass ceramic material available from Ceramic Products Inc of Hasbrouck Heights, N.J.

Aspects of an embodiment of the invention may include a magnetic proximity switch 20 having an internal magnet 42 that moves a first internal shaft 26 toward a magnetic target 62 when a target is within a given distance of a sensor end 43 of the switch; wherein the first internal shaft 26 compresses a second spring 64 that pushes against a second internal shaft 28, wherein the first internal shaft 26 has an engagement pin 46 that causes a second claw 52 to release the second internal shaft 28, which closes a movable contact 32 against a first fixed contact 34, and then the spring 49 causes a first claw 48 to lock the second internal shaft 28 in place. When the target 62 moves out of the given distance, a first spring 44 moves the first shaft 26 away from the sensor end 43 of the switch, causing the second spring 64 to push the second internal shaft 28 away from the sensor end 43 of the switch, and then the engagement pin 46 causes the first claw 48 to release the second internal shaft 28, which then closes the movable contact 32 against a second fixed contact 38, and then the spring 53 causes the second claw 52 to lock the second internal shaft 28 in place.

Further aspects of an embodiment of the invention may include a magnetic proximity switch 20 in an elongated housing 22 with a sensor end 43 and a cable end 24; a sensor magnet 42 in the sensor end of the housing; the sensor magnet attached to an inner shaft 26 that slides within an outer shaft 28, wherein the outer shaft 28 slides along a shaft support 29 that is within the housing 22, and the shaft support 29 is fixed relative to the housing; a movable electrical contact 32 attached to the outer shaft 28; a first spring 44 urging the inner shaft 26 toward the cable end 24 of the housing; an engagement pin 46 extending from the inner shaft 26 through a slot 45 in the outer shaft 28 and through a slot 47 in the shaft support 29; first and second locking posts 56, 58 extending from the outer shaft 28 through slots 57, 59 in the shaft support 29; first and second claws 48, 52 that pivot on respective axles 50, 54, wherein the axles extend from the shaft support 29; the claws 48, 52 urged into respective latched positions over the respective locking posts 56, 58 by respective third and fourth springs 49, 53; a second spring 64 in a chamber 65 the inner shaft; the second spring 64 retained between first and second spring blocks 66, 68; first and second guide pins 67, 69 extending from the respective spring blocks 66, 68 and passing through a guide slot 70 in the inner shaft 26 and through a guide slot 71 in the outer shaft 29; wherein the inner shaft 26 moves toward the sensor end 43 of the housing when a magnetic target 62 is within a given distance of the sensor end 43 of the housing, and this movement compresses the second spring, which causes the second guide pin 69 on the second spring block 68 to push against a sensor end 73 of the slot 70 in the outer shaft 28, then said movement causes the engagement pin 46 to push against the second claw 52, unlocking the second claw from the second locking post 58 and releasing the outer shaft 28, which moves suddenly toward the sensor end 73 of the housing, closing the movable contact 32 against a first fixed contact 34, at which time the first claw 48 locks over the first locking post 56, preventing contact bounce or disconnection until the magnetic target 62 is moved beyond the given distance from the sensor end 43 of the housing.

Figure 8:
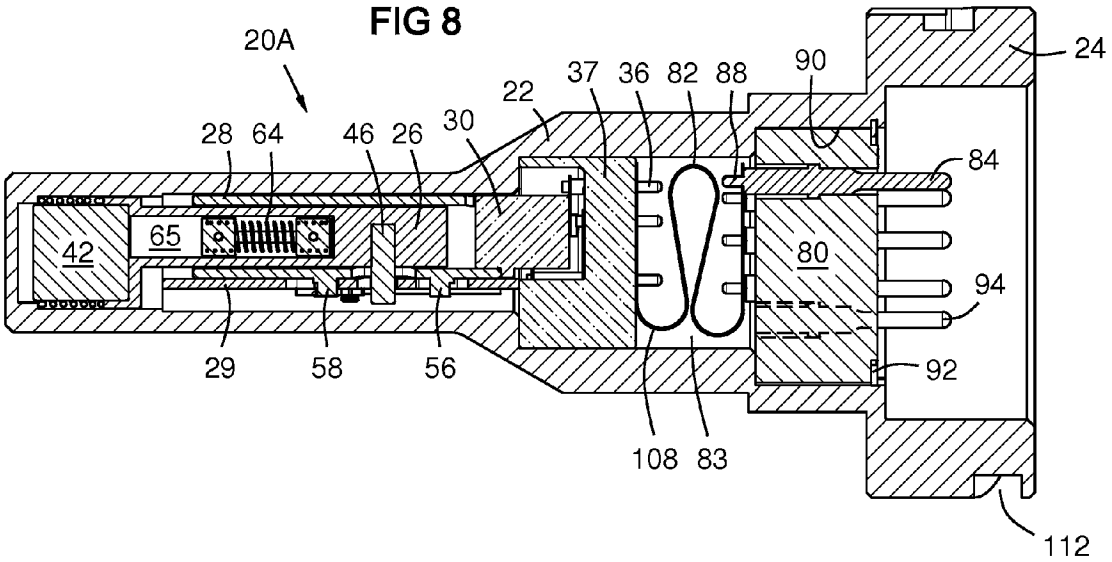
FIG. 8 is a side sectional view of an embodiment with a connector pin-out adapter.

FIG. 8 shows an embodiment 20A of the present switch with a pin-out adapter block 80 that is connected to the switch output leads 36 by a flexible circuit 82, providing a pin-out configuration for an existing client cable plug. Pin-out conductors 84 pass through the adapter block 80 to corresponding adapter input pins 88. The pin-out conductors 84 may be pins as shown or sockets not shown, depending on the client plug gender. The flexible circuit 82 electrically connects some or all of the adapter input pins 88 to corresponding switch leads 36 as needed. The adapter block 80 is inserted into an adapter chamber 90, and locked therein with a device 92 such as an expanding circlip. The adapter block 80 may be keyed 81 (FIG. 11) to the chamber 90 for proper orientation. Pin-out conductors 84 that are inactive may or may not include an adapter input pin 88. Eliminating the adapter input pin as shown for conductor 94, allows more space for the flexible circuit 82. On the other hand, providing an input pin 88 on an inactive conductor 84 provides additional mechanical connection for the flexible circuit 82. The flexible circuit 82 may be folded into a space or chamber 83 in the housing 22 between the input pins 88 and the output leads 36.

Figure 9:
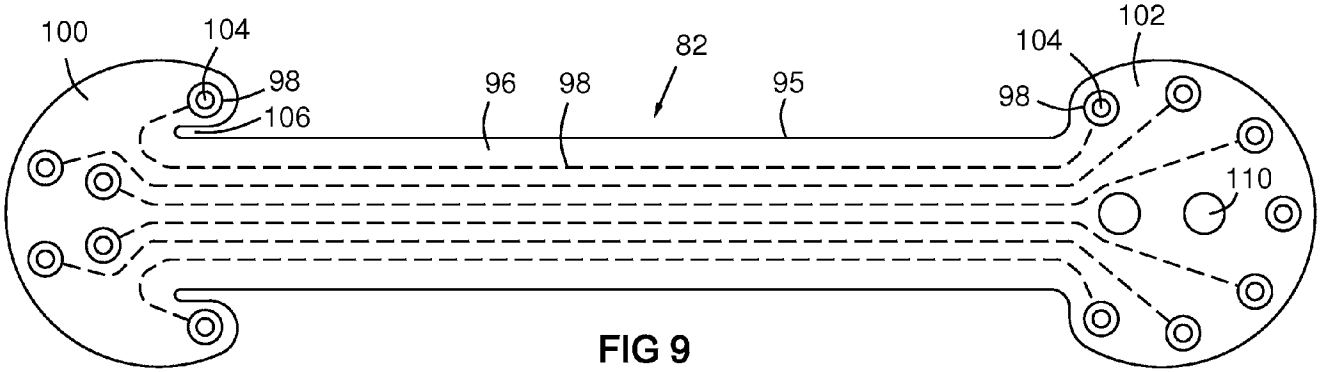
FIG. 9 is a schematic view of a flexible circuit that connects the switch output leads to input pins on the connector adapter block.

FIG. 9 is a schematic view of the flexible circuit 82, comprising a ribbon portion 95 and two end portions 100, 102. The circuit 82 is formed of a flexible dielectric substrate 96 using a material such as polyimide. Flexible conductor traces 98 may be formed using a material such as copper. Other materials may be used as known in flexible circuit technology. The thinness of the flexible conductor allows the switch output leads 36 and the adapter block input pins 88 to be shorter than normal plug or jack pins—for example less than 0.13" long.

The flexible circuit 82 has a first end 100 configured for connection to the switch leads 36, and a second end 102 configured for connection with the adapter input pins 88. Each connection point comprises a hole 104 surrounded by the conductor 98. The holes 104 may sized for an interference fit on the pins 36, 88. This fit holds the circuit ends 100, 102 in place after being pressed onto the pins 36, 88, at which time the pins 36, 38 may be soldered or mechanically attached to the surrounding conductors 98.

Cut-outs 106 may be provided between the ribbon portion 95 and an end portion 100 as shown. This allows the adjacent bend 108 of the ribbon portion 95 to start sooner, shortening the length of the ribbon portion 95 that is needed for assembly. Non-contact holes 110 in an end portion 102 of the flexible circuit may be provided in conjunction with holes 111 (FIG. 11) through the adapter block 80 for pressure relief, application of potting material, or other purposes.

FIG. 10 is a perspective view of the embodiment 20A of FIG. 8. The coupler 24 may include a mechanism 112 for interlocking with threads and/or latches on the respective coupler of the client plug. FIG. 11 is a connector-end view of the embodiment of FIG. 8, showing nine exemplary pin-out conductors identified by the letters A-I. FIG. 12 shows end 102 of the flexible circuit configured for six active pin-out conductors B, C, D, F, G, and H of FIG. 11 for a double-pole double-throw configuration of the switch 20A. FIG. 13 shows end 102 of the flexible circuit configured for three active pin-out conductors B, C, and D of FIG. 11 for a single-pole double-throw configuration of the switch 20A. Adapter input pins 88 may be eliminated for conductors A and I as shown for conductor 94 in FIG. 8. An input pin 88 may be provided for conductor E for mechanical connection even though it is electrically inactive. These are just examples of a possible pin-out configurations and options.

Benefits of the flexible circuit 82 and adapter block 80 include: 1) Provides an integrated connector adapter for an existing client cable plug; 2) Provides a flexible connection between the connector adapter block 80 and the switch leads 36 without a mess of wires; 3) Reduces the possibility of an assembly mistake; 4) Allows easy rewiring of the pin-out configuration with a simple change of circuit traces; 5) Provides a simple connection to the connector adapter in a short space without external adapters.

While various embodiments of the present invention have been shown and described herein, it will be obvious that such embodiments are provided by way of example only. Numerous variations, changes and substitutions may be made without departing from the invention herein.

The invention claimed is:

1. A proximity switch for monitoring the operating position of a mechanical device and selectively opening and closing an electrical circuit in response thereto, the switch comprising:

inner and outer shafts in a housing;

a first spring that urges the inner shaft away from a sensor end of the housing;

a magnet on the inner shaft that moves the inner shaft toward the sensor end of the housing against the urging of the first spring when a magnetic target is proximate the sensor end of the housing;

a second spring in the housing interposed between the inner and outer shafts;

a lock selectively allowing or preventing relative movement between the outer shaft and the housing;

a moveable electrical contact on the outer shaft moveable with the outer shaft between first and second positions in engagement with a respective first or second fixed electrical contact in the housing;

wherein a movement of the inner shaft in either a first or second direction in response to a movement of the target relative to the sensor end of the housing causes the second spring to urge the outer shaft in a direction of the movement of the first shaft, and then releases the lock allowing the second shaft to move as urged by the second spring to move the moveable electrical contact between the first and second positions, and then causes the lock to reengage to secure the movable electrical contact in its engaged position and prevent movement thereof relative to the respective fixed electrical contact.

2. The switch of claim 1, wherein;

the outer shaft is slidably mounted within the housing;

the inner shaft is slidably mounted within the outer shaft;

the magnet urges the inner shaft leftward when the target is proximate the sensor end of the housing, wherein "leftward" and "rightward" mean toward or away from the sensor end of the housing respectively;

the first spring urges the inner shaft rightward;

the second spring pushes rightward or leftward on the outer shaft via respective right or left guide pins in response to respective rightward or leftward movement of the first shaft; and the lock prevents movement of the outer shaft until the second spring is compressed by the movement of the inner shaft, then the lock is moved by an engagement pin on the inner shaft, which releases the lock allowing the outer shaft to snap rightward or leftward as urged by the second spring, closing or opening the movable contact against corresponding ones of the fixed electrical contacts.

3. The switch of claim 1, further comprising;

a shaft support that is fixed within the housing;

wherein the outer shaft slides within the shaft support, and the inner shaft slides within the outer shaft;

wherein the lock comprises left and right locking claws with respective pivot axles fixed to the shaft support, wherein "left" and "right" mean toward or away from the sensor end of the housing respectively;

wherein the left and right locking claws are urged by respective third and fourth springs on the shaft support to hook respective left and right locking posts attached to the outer shaft; and wherein an engagement pin on the inner shaft opens alternative ones of the locking claws by contacting it and pivoting it away from the respective locking post, releasing the outer shaft to move as urged by the second spring.

4. The switch of claim 3, further comprising:

left and right spring blocks slidably mounted in a chamber for the second spring in the inner shaft, wherein the second spring spans between the spring blocks; and left and right guide pins on the respective spring blocks, wherein the guide pins extend through an inner guide slot in the inner shaft into an outer guide slot in the outer shaft;

wherein rightward movement of the inner shaft moves the left spring block rightward, compressing the second spring and causing the right guide pin to push rightward against a right end of the outer guide slot; and wherein leftward movement of the inner shaft moves the right spring block leftward, compressing the second spring and causing the left guide pin to push leftward against a left end of the outer guide slot.

5. The switch of claim 1 further comprising:

output leads in the housing that are electrically connected to respective ones of the fixed electrical contacts;

a cable adapter plug in the housing, comprising a plurality of outwardly-extending pin-out conductors that pass inwardly through the cable adapter plug to corresponding adapter input pins in the housing; and a flexible circuit that is folded into a chamber in the housing between the input pins and the output leads;

wherein the flexible circuit electrically interconnects the output leads to respective adapter input pins.

6. The switch of claim 5 wherein the flexible circuit comprises:

a ribbon middle portion with first and second end portions, wherein the first end portion comprises a first plurality of holes corresponding to the output leads, and the second end portion comprises a second plurality of holes corresponding to the adapter input pins; and conductive traces on the flexible circuit between corresponding ones of the first and second plurality of holes.

7. A proximity switch for monitoring the operating position of a mechanical device and selectively opening and closing an electrical circuit in response thereto, the switch comprising:

an outer shaft slidably mounted in a housing;

an inner shaft slidably mounted within the outer shaft;

a magnet on a left end of the inner shaft that urges the inner shaft leftward when a target is proximate a left end of the housing, wherein "left" and "right" mean toward a first and second end of the housing respectively;

a first spring that urges the inner shaft rightward;

a second spring that urges the outer shaft rightward or leftward in response to respective rightward or leftward movement of the inner shaft; and a locking mechanism actuated by an engagement pin on the inner shaft that prevents movement of the outer shaft until the second spring is compressed, then releases the outer shaft to snap rightward or leftward as urged by the second spring, snapping a movable electrical contact on the outer shaft between first and second positions relative to a fixed electrical contact in the housing.

8. The switch of claim 7, further comprising:

a shaft support that is fixed within the housing;

wherein the outer shaft slides within the shaft support;

wherein the locking mechanism comprises left and right locking claws with respective pivot axles fixed to the shaft support;

wherein the left and right locking claws are urged by respective third and fourth springs on the shaft support to engage respective left and right locking posts attached to the outer shaft; and wherein the engagement pin opens one of the locking claws by contacting it and pivoting it away from the respective locking post, releasing the outer shaft to move as urged by the second spring.

9. The switch of claim 8, further comprising:

left and right spring blocks slidably mounted in a chamber for the second spring in the inner shaft, wherein the second spring spans between the spring blocks; and left and right guide pins on the respective spring blocks, wherein the guide pins extend through an inner guide slot in the inner shaft into an outer guide slot in the outer shaft;

wherein rightward movement of the inner shaft moves the left spring block rightward, compressing the second spring and causing the right guide pin to push rightward against a right end of the outer guide slot; and wherein leftward movement of the inner shaft moves the right spring block leftward, compressing the second spring and causing the left guide pin to push leftward against a left end of the outer guide slot.

10. The switch of claim 7 further comprising:

output leads in the housing that are electrically connected to respective ones of the contacts;

a cable adapter plug in the housing, comprising a plurality of outwardly-extending pin-out conductors that pass inwardly through the cable adapter plug to corresponding adapter input pins in the housing; and a flexible circuit that is folded into a chamber in the housing between the output leads and the adapter input pins;

wherein the flexible circuit electrically interconnects the output leads to corresponding ones of the adapter input pins and coverts the lead configuration to a different pin configuration of a particular client cable plug.

11. The switch of claim 10 wherein the flexible circuit comprises:

a ribbon middle portion with first and second end portions, wherein the first end portion comprises a first plurality of holes corresponding to the output leads, and the second end portion comprises a second plurality of holes corresponding to the adapter input pins; and conductive traces on the flexible circuit between corresponding ones of the first and second plurality of holes.

12. A proximity switch for monitoring the operating position of a mechanical device and selectively opening and closing an electrical circuit in response thereto, the switch comprising:

an inner shaft that slides linearly within an outer shaft, wherein the outer shaft slides linearly within a housing;

a magnet on a left end of the inner shaft, wherein "left" and "right" mean toward a first and second end of the housing respectively;

a first spring urging the inner shaft rightward;

movable electrical contacts on a right end of the outer shaft, and fixed electrical contact in the housing that are fixed relative to the housing;

an engagement pin on the inner shaft that releases a left locking claw from a left locking post on the outer shaft when the inner shaft moves leftward, and releases a right locking claw from a right locking post on the outer shaft when the inner shaft moves rightward, wherein each locking claw pivots on a respective axle that is fixed relative to the housing; and a second spring that is compressed by relative movement between the inner shaft and the outer shaft;

wherein leftward movement of the inner shaft causes the second spring to urge the outer shaft leftward, then the engagement pin releases the left locking claw, releasing the outer shaft to snap leftward, snapping the movable electrical contacts into a first position relative to the fixed electrical contacts;

wherein rightward movement of the inner shaft causes the second spring to urge the outer shaft rightward, then the engagement pin releases the right locking claw, releasing the outer shaft to snap rightward, snapping the movable electrical contacts into a second position relative to the fixed electrical contacts; and wherein the left and right locking claws are urged by respective third and fourth springs to engage the left and right locking posts respectively unless released by the engagement pin.

13. The switch of claim 12, further comprising:

a shaft support fixed to the housing;

wherein the outer shaft slides within the shaft support;

wherein the engagement pin extends through respective slots in the outer shaft and the shaft support; and wherein the axle of each locking claw is fixed to the shaft support.

14. The switch of claim 12, further comprising:

left and right spring blocks slidably mounted in a chamber for the second spring in the inner shaft, wherein the second spring spans between the spring blocks; and left and right guide pins on the respective spring blocks, wherein the guide pins extend through an inner guide slot in the inner shaft into an outer guide slot in the outer shaft;

wherein rightward movement of the inner shaft moves the left spring block rightward, compressing the second spring, causing the right guide pin to push rightward against a right end of the outer guide slot; and wherein leftward movement of the inner shaft moves the right spring block leftward, compressing the second spring, causing the left guide pin to push leftward against a left end of the outer guide slot.

15. The switch of claim 12 further comprising:

output leads in the housing that are electrically connected to corresponding ones of the fixed contacts;

a cable adapter plug in the housing, comprising a plurality of outwardly-extending pin-out conductors that pass inwardly through the cable adapter plug to corresponding adapter input pins in the housing; and a flexible circuit that is folded into a chamber in the housing between the output leads and the input pins;

wherein the flexible circuit electrically interconnects the output leads to corresponding ones of the input pins and coverts the lead configuration to a different pin configuration of a particular client cable plug.

16. The switch of claim 15 wherein the flexible circuit comprises:

a ribbon portion with first and second end portions, wherein the first end portion comprises a first plurality of holes corresponding to the output leads, and the second end portion comprises a second plurality of holes corresponding to the adapter input pins; and conductive traces on the flexible circuit between corresponding ones of the first and second plurality of holes.

17. The switch of claim 1 further comprising: a pin-out adapter block in a right end of the housing, the pin-out adapter block comprising pin-out conductors disposed in a pin configuration matching a particular client cable plug;

a flexible circuit that electrically connects selected output leads from the fixed contacts to selected ones of the pin-out conductors to match the pin configuration of the particular client plug, adapting the switch to the particular client cable plug.

18. The switch of claim 17 comprising a set of adapter blocks and flexible circuits that provide a selectable integrated pin-out connector in the switch for different client cable plugs.

19. The switch of claim 7 further comprising:

a pin-out adapter block in a right end of the housing, the adapter block comprising pin-out conductors disposed in a pin configuration matching a particular client cable plug;

a flexible circuit that electrically connects selected output leads from the fixed contacts to selected ones of the pin-out conductors to match the pin configuration of the particular client plug, adapting the switch to the particular client cable plug.

20. The switch of claim 19 comprising a set of adapter blocks and flexible circuits that provide a selectable integrated pin-out connector in the switch for different client cable plugs, wherein at least one flexible circuit of the set electrically connects only a subset of the output leads to the pin-out conductors of one of the adapter blocks of the set.

* * * * *